US008844176B2

(12) United States Patent
Hiraoka et al.

(10) Patent No.: US 8,844,176 B2
(45) Date of Patent: Sep. 30, 2014

(54) SHEET MATERIAL CONVEYING APPARATUS

(71) Applicant: Toyota Boshoku Kabushiki Kaisha, Aichi-ken (JP)

(72) Inventors: Daisuke Hiraoka, Tokoname (JP); Masayuki Shirata, Toyota (JP)

(73) Assignee: Toyota Boshoku Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/867,454

(22) Filed: Apr. 22, 2013

(65) Prior Publication Data

US 2013/0298431 A1 Nov. 14, 2013

(30) Foreign Application Priority Data

May 11, 2012 (JP) ..... 2012-109735

(51) Int. Cl.
*D06F 61/02* (2006.01)
*B65H 20/30* (2006.01)
*D06F 67/00* (2006.01)

(52) U.S. Cl.
CPC ..... *D06F 61/02* (2013.01); *B65H 20/30* (2013.01); *B65H 2511/112* (2013.01); *B65H 2557/24* (2013.01); *B65H 2513/10* (2013.01)
USPC ..... 38/52

(58) Field of Classification Search
USPC ..... 38/7–11, 44, 49, 63; 100/327–336, 47
See application file for complete search history.

(56) References Cited

U.S. PATENT DOCUMENTS

| | | | | |
|---|---|---|---|---|
| 3,344,542 | A * | 10/1967 | Watson | 38/101 |
| 5,315,404 | A * | 5/1994 | Kuboki et al. | 358/426.02 |
| 5,724,085 | A * | 3/1998 | Inui et al. | 347/175 |
| 6,447,186 | B1 * | 9/2002 | Oguchi et al. | 400/621 |
| 6,827,817 | B2 * | 12/2004 | Bleckmann et al. | 156/73.1 |
| 7,444,114 | B2 * | 10/2008 | Tanimoto | 399/396 |
| 8,391,738 | B2 * | 3/2013 | Hasegawa | 399/68 |
| 2007/0039495 | A1 * | 2/2007 | Sakamoto | 101/228 |
| 2012/0087707 | A1 * | 4/2012 | Igarashi | 400/611 |
| 2013/0165585 | A1 * | 6/2013 | Tadepalli et al. | 524/606 |

FOREIGN PATENT DOCUMENTS

JP 2011-162915 8/2011

* cited by examiner

*Primary Examiner* — Ismael Izaguirre
(74) *Attorney, Agent, or Firm* — Greenblum & Bernstein, P.L.C.

(57) ABSTRACT

A conveying apparatus includes a first roller that is rotational to convey a nonwoven fabric and a second roller that is rotational to convey the nonwoven fabric and is located on the trailing side of the first roller with respect to the conveying direction of the nonwoven fabric. The conveying apparatus includes a noncontact sensor and a controller. The noncontact sensor detects the distance from the nonwoven fabric at a position between the first roller and the second roller. The controller uses the distance detected by the sensor to compute the slack amount of the nonwoven fabric and controls the rotation speed of the second roller, thereby reducing the difference between the computed slack amount and a predetermined target value.

11 Claims, 3 Drawing Sheets

SHEET MATERIAL CONVEYING APPARATUS

CROSS-REFERENCE TO RELATED APPLICATIONS

This application is based upon and claims the benefit of priority from prior Japanese Patent Application No. 2012-109735, filed on May 11, 2012, the entire contents of which are incorporated herein by reference.

BACKGROUND OF THE INVENTION

The present invention relates to a conveying apparatus for conveying sheet material such as nonwoven fabric.

Conveying apparatuses that convey nonwoven fabric formed through the melt-blowing process have been known (for example, Japanese Laid-Open Patent Publication No. 2011-162915).

Such conveying apparatuses are structured to convey nonwoven fabric using rollers. These rollers are rotated by motors.

In recent years, nonwoven fabrics having low Young's moduli have been developed. When such nonwoven fabric is conveyed by a conveying apparatus, wrinkles and stretches are likely formed in the fabric. Therefore, the rollers must be rotated at low speeds, and rotations of the rollers must be synchronized so that the tension acting on the fabric between the rollers is maintained at a constant value. However, in a conveying apparatus that is configured such that rollers are rotated at low speeds, the lower the rotation speeds of the motors, the less stable the rotations of the motors, that is, the rotations of the rollers become. Thus, in reality, rotations of the rollers cannot be accurately synchronized, and wrinkles and stretches in nonwoven fabric are inevitable during conveyance of nonwoven fabric.

A structure has been proposed in which rotations of motors are transmitted to rollers via reduction gears to reduce the rotation speeds of rollers and synchronize the rotations of the rollers. This structure prevents rotations of the rollers from being unstable. However, since large-size reduction gears are required, the conveying apparatus has a complex structure.

These drawbacks are present not only in apparatuses for conveying nonwoven fabric, but also commonly found in apparatuses for carrying other types of sheet materials.

SUMMARY OF THE INVENTION

Accordingly, it is an objective of the present invention to provide a sheet material conveying apparatus that is capable of conveying a sheet material having a low Young's modulus while suppressing the formation of wrinkles and stretches in the fabric.

To achieve the foregoing objective, and in accordance with one aspect of the present invention, a conveying apparatus for conveying a sheet material in a conveying direction is provided. The conveying apparatus includes a first roller and second roller. The first roller is rotational to convey the sheet material. The second roller is rotational to convey the sheet material and is located on the trailing side of the first roller with respect to the conveying direction of the sheet material. The conveying apparatus further includes a noncontact sensor and a controller. The sensor detects a distance from the sheet material at a position between the first roller and the second roller. The controller computes a slack amount of the sheet material using the distance detected by the sensor and controls at least one of rotation speed of the first roller and rotation speed of the second roller such that a difference between the computed slack amount and a predetermined target value is reduced.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A conveying apparatus for conveying unwoven fabric according to one embodiment will now be described with reference to FIGS. 1 to 3. The conveying apparatus forms part of an apparatus for manufacturing nonwoven fabric.

Figure 1:
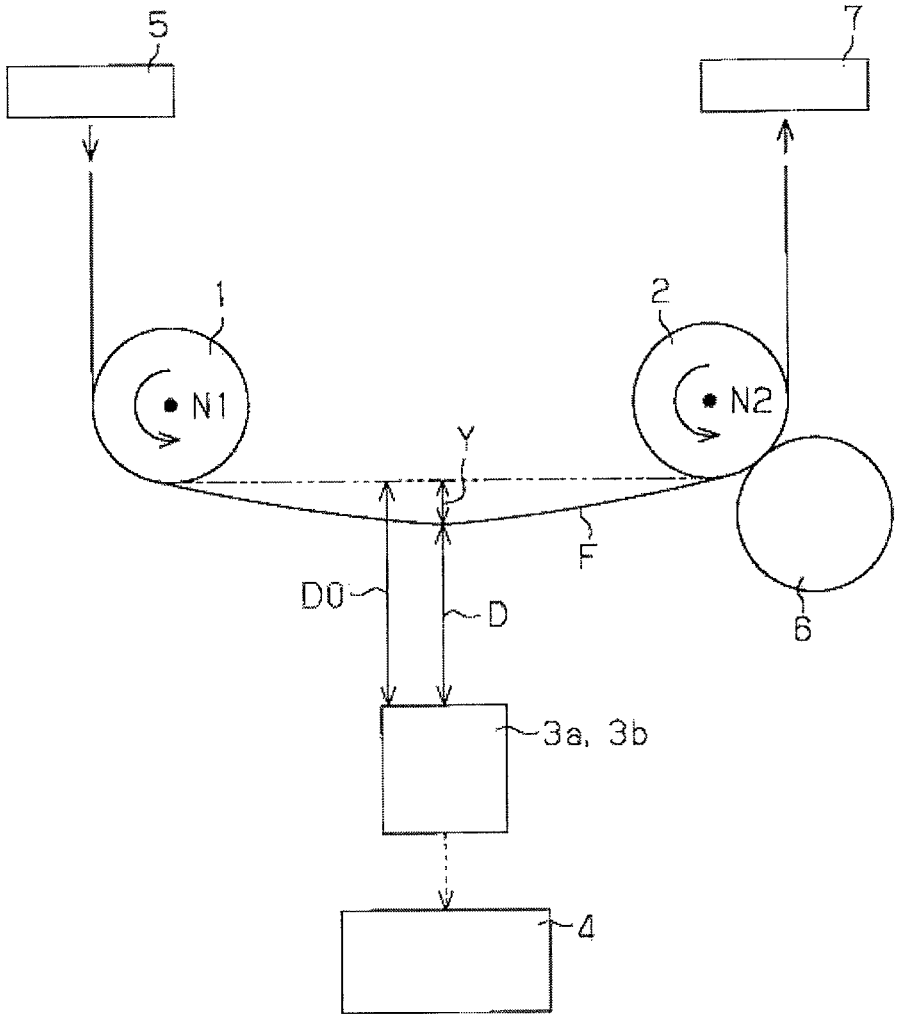
FIG. 1 is a front view schematically showing the frontal structure of a conveying apparatus according to one embodiment of the present invention.

As shown in FIG. 1, the conveying apparatus conveys nonwoven fabric F in a conveying direction from a spinning apparatus 5 to a winding roller 7. The conveying apparatus includes a first roller 1 and a second roller 2, which are rotational to convey the nonwoven fabric F. The second roller 2 is located on the trailing side of the first roller 1 with respect to the conveying direction of the nonwoven fabric F. That is, the second roller 2 is further away from the spinning apparatus 5 and closer to the winding roller 7 in the conveying path of the nonwoven fabric F than the first roller 1 is.

The spinning apparatus 5 produces the nonwoven fabric F by the melt blowing process. A rotational auxiliary roller 6 is provided on the opposite side of the conveyed nonwoven fabric F to the second roller 2. Together with the auxiliary roller 6, the second roller 2 pressurizes and heats the nonwoven fabric F, which has been conveyed via the first roller 1.

In the present embodiment, the height of the lowest part of the first roller 1 is equal to the height of the lowest part of the second roller 2.

Figure 2:
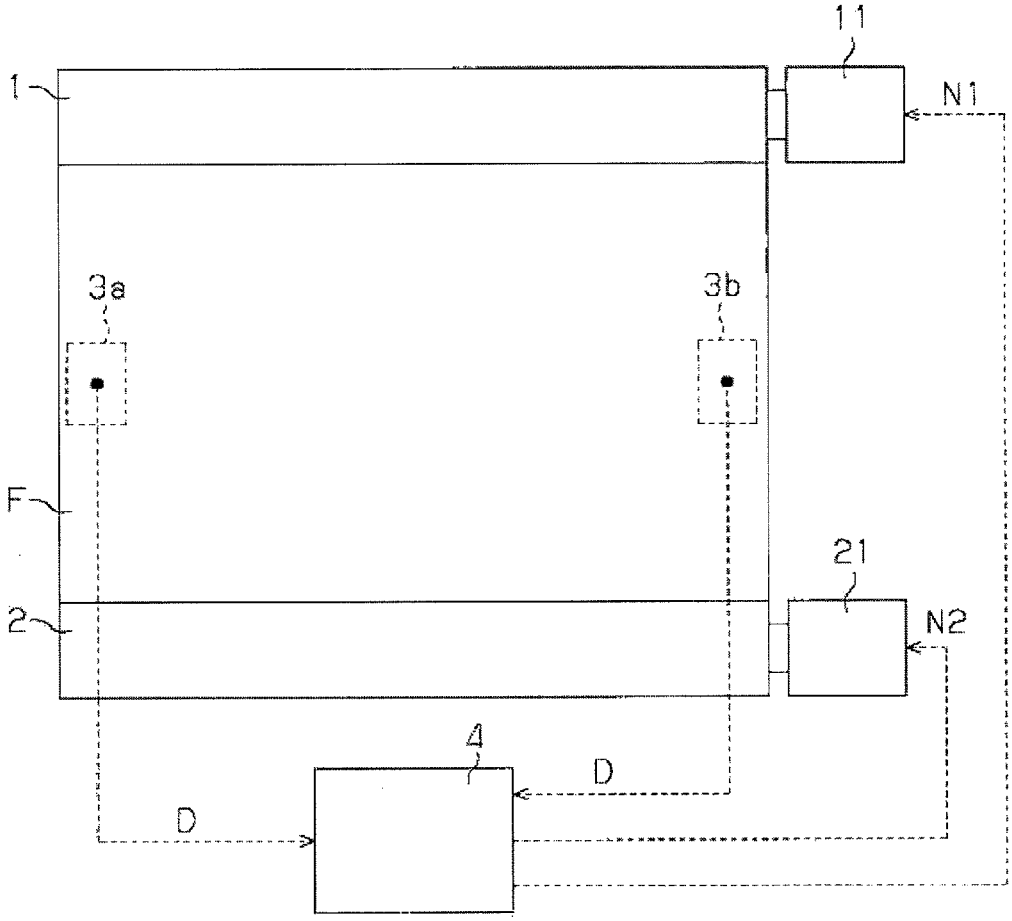
FIG. 2 is a plan view showing the planar structure of the conveying apparatus of the embodiment shown in FIG. 1.

As shown in FIG. 2, a first motor 11 and a second motor 21 are respectively coupled to ends of the first roller 1 and the second roller 2 (the right ends as viewed in FIG. 2) to electrically rotate the rollers 1 and 2. The conveying apparatus includes a controller 4, which controls the rotation speed of the first motor 11 (that is, a rotation speed N1 of the first roller 1) and the rotation speed of the second motor 21 (that is, a rotation speed N2 of the second roller 2).

The conveying apparatus further includes two noncontact sensors 3*a*, 3*b* located between the first roller 1 and the second roller 2 and below the nonwoven fabric F. The sensors 3*a*, 3*b* each detect a distance D from the nonwoven fabric F. The sensors 3*a*, 3*b* are located below the nonwoven fabric F at both edges in the width direction (the right-left direction in FIG. 2) of the nonwoven fabric F. The sensors 3*a*, 3*b* are laser sensors. The sensors 3*a*, 3*b* detect the distances D between the sensors 3*a*, 3*b* and the nonwoven fabric F and send the detected distances D to the controller 4. A reference line is represented in FIG. 1 by a broken line in which a long dash alternates with a pair of short dashes, and the distance between the reference line and the sensors 3*a*, 3*b* is defined as a reference distance D0. The controller 4 subtracts the average of the distances D detected by the sensors 3*a*, 3*b* from the reference distance D0, thereby computing a slack amount Y. The reference line connects the lowest part of the first roller 1 and the lowest part of the second roller 2. When the nonwoven fabric F is located on the reference line, the slack amount Y is zero. In the present embodiment, the slack amount Y of the nonwoven fabric F is maximized at the middle position between the first roller 1 and the second roller 2 in the conveying direction of the nonwoven fabric F. The sensors 3*a*, 3*b* are located below the nonwoven fabric F at the middle position. That is, the slack amount Y of the nonwoven fabric F at the maximum slack position, where the slack amount Y is maximized between the first roller 1 and the second roller 2, can be obtained by using detection results of the sensors 3*a*, 3*b*.

The controller 4 controls the rotation speed N1 of the first roller 1 to be a constant speed, and controls the rotation speed N2 of the second roller 2 such that the slack amount Y of the nonwoven fabric F becomes equal to a predetermined target value Ytrg.

The following expression 1, which is a catenary equation, defines the relationship between a tension A (kgf) that acts on the nonwoven fabric F between the first roller 1 and the second roller 2 and the slack amount Y (m) of the nonwoven fabric F. The predetermined target value Ytrg (m) is set based on the expression 1.

$$Ytrg = \frac{A}{B}\left(1 - \cosh\left(\frac{LB}{2A}\right)\right) \quad \text{(Expression 1)}$$

In the expression 1, B represents the weight of the nonwoven fabric F per unit length (kgf/m), and L represents the distance (m) between the first roller 1 and the second roller 2. In other words, when the mass of the nonwoven fabric F per unit length is presented by b (kg/m), the tension acting on the nonwoven fabric F is represented by T (N) in the SI units, and the gravitational acceleration is represented by g (m/s$^2$), the target value Ytrg of the slack amount Y is represented by the following expression.

$$Ytrg = \frac{T}{bg}\left(1 - \cosh\left(\frac{Lbg}{2T}\right)\right)$$

The tension T (N) and the tension A (kgf) satisfy the relationship T=Ag. In the present embodiment, a desired magnitude of the tension A (kgf) or of the tension T (N) is obtained through experimentation, and the target value Ytrg of the slack amount Y of the nonwoven fabric F is set in advance.

Next, the procedure for controlling the rotation speed of the second roller 2 will be described with reference to FIG. 3. A series of processes shown in FIG. 3 is repeatedly executed at predetermined control cycle (for example, 0.1 second).

Figure 3:
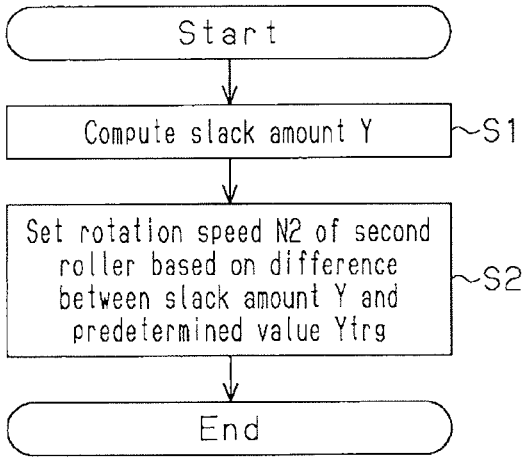
FIG. 3 is a flowchart showing a procedure of rotation speed control for a second roller in the embodiment shown in FIG. 1.

In the series of processes, the controller 4 computes the slack amount Y of the nonwoven fabric F based on detection results of the sensors 3*a*, 3*b* as shown in FIG. 3 (step S1). The controller 4 receives detected values from the sensors 3*a*, 3*b* at an interval (for example, 0.001 second) that is shorter than the control cycle of the rotation speed control, which is 0.1 second. In reality, the controller 4 executes smoothing of values that have been detected during the period from the previous execution cycle to the current cycle of the rotation speed control, and uses the resultant to compute the slack amount Y in step S1.

Next, the controller 4 proceeds to step S2, in which the controller 4 sets the rotation speed N2 of the second roller 2 such that the difference between the computed slack amount Y and the target value Ytrg is reduced. Then, the controller 4 temporarily suspends the series of processes.

If the two distances D detected by the sensors 3*a*, 3*b* are largely different from each other, there is likely to be an abnormality in conveyance of the nonwoven fabric F. In this case, rotations of the rollers 1, 2 are preferably stopped.

Operation of the present embodiment will now be described.

According to the present embodiment, the slack amount Y of the nonwoven fabric F between the first roller 1 and the second roller 2 is computed using the detection results of the noncontact sensors 3*a*, 3*b*, and the rotation speed N2 of the second roller 2 is controlled such that the slack amount Y becomes equal to the target value Ytrg. Therefore, the slack amount Y of the nonwoven fabric F can be detected without contacting the nonwoven fabric F, and the rotation speed N2 of the second roller 2 is controlled based on the slack amount Y of the nonwoven fabric F, that is, the tension A acting on the nonwoven fabric F.

According to the present embodiment, the slack amount Y of the nonwoven fabric F is computed at a position where the slack amount Y is maximized using detection results of the sensors 3*a*, 3*b*. Thus, even if the tension A, which acts on the nonwoven fabric F, changes subtly and the slack amount Y changes slightly, the slack amount Y of the nonwoven fabric F is reliably computed.

Further, the nonwoven fabric F, which is made by the spinning apparatus 5, is conveyed via the first roller 1 and the second roller 2 and wound by the winding roller 7. When passing the second roller 2, the nonwoven fabric F is pressed and heated by the second roller 2 and the auxiliary roller 6. That is, conveyance, pressurization, and heating of the nonwoven fabric F are performed simultaneously. Therefore, after being wound by the winding roller 7, the nonwoven fabric F needs not be drawn out to be pressed or heated. It is therefore possible to efficiently produce the nonwoven fabric F.

The conveying apparatus according to the above described embodiment has the following advantages.

(1) The conveying apparatus includes the noncontact sensors 3*a*, 3*b* and the controller 4. The noncontact sensors 3*a*, 3*b* detect the distances D from the nonwoven fabric F at a position between the first roller 1 and the second roller 2. The controller 4 uses the distances detected by the sensors 3*a*, 3*b* to compute the slack amount Y of the nonwoven fabric F and controls the rotation speed N2 of the second roller 2, thereby reducing the difference between the computed slack amount Y and the predetermined target value Ytrg. According to this configuration, even if the Young's modulus of the nonwoven fabric F is low, it is possible to convey the nonwoven fabric F while reliably reducing wrinkles and stretches of the nonwoven fabric F.

(2) The controller 4 controls the rotation speed N1 of the first roller 1 to be a constant speed, and controls the rotation speed N2 of the second roller 2 to reduce the difference between the computed slack amount Y of the nonwoven fabric F and the target value Ytrg. According to this configuration, the rotation speeds of the rollers 1, 2 can be easily and accurately controlled compared to a case in which both of the rotation speeds N1 and N2 of the first and second rollers 1, 2 are controlled based on the slack amount Y of the nonwoven fabric F.

(3) The sensors 3*a*, 3*b* are laser sensors. According to this configuration, the distances D between the sensors 3*a*, 3*b* and the nonwoven fabric F are accurately detected, and the slack amount Y of the nonwoven fabric F can be accurately computed. This allows the slack amount Y to be finely adjusted.

(4) The sensors 3*a*, 3*b* detect the distances D from the nonwoven fabric F at the maximum slack position, where the slack amount Y is maximized, between the first roller 1 and the second roller 2. According to this configuration, even if the tension A, which acts on the nonwoven fabric F, changes subtly so that the slack amount Y changes slightly, the slack amount Y of the nonwoven fabric F is accurately obtained.

(5) The second roller 2 performs both pressurizing and heating of the nonwoven fabric F, which has been conveyed via the first roller 1. According to this configuration, the conveyance, pressurization, and heating of the nonwoven fabric F are performed simultaneously. This allows the nonwoven fabric F to be efficiently produced.

The sheet material conveying apparatus according to the present invention is not to be restricted to configurations shown in the above embodiment, but may be modified as shown below.

To efficiently produce the nonwoven fabric F, it is preferable, as in the above embodiment, that the second roller 2 pressurizes and heats the nonwoven fabric F. However, the present invention is not limited to this, and the second roller does not need to heat the nonwoven fabric F.

Also, the second roller does not need to be configured to pressurize the nonwoven fabric F. That is, the auxiliary roller 6 may be omitted, so that the second roller only has functions of conveying and heating the nonwoven fabric F. Further, the second roller may only have a function of conveying the nonwoven fabric F.

In the above embodiment, the conveying apparatus for conveying the nonwoven fabric F, which is formed through the melt-blowing process, is exemplified. However, the process for producing nonwoven fabric is not limited thereto, and other producing processes may be employed.

Figure 4:
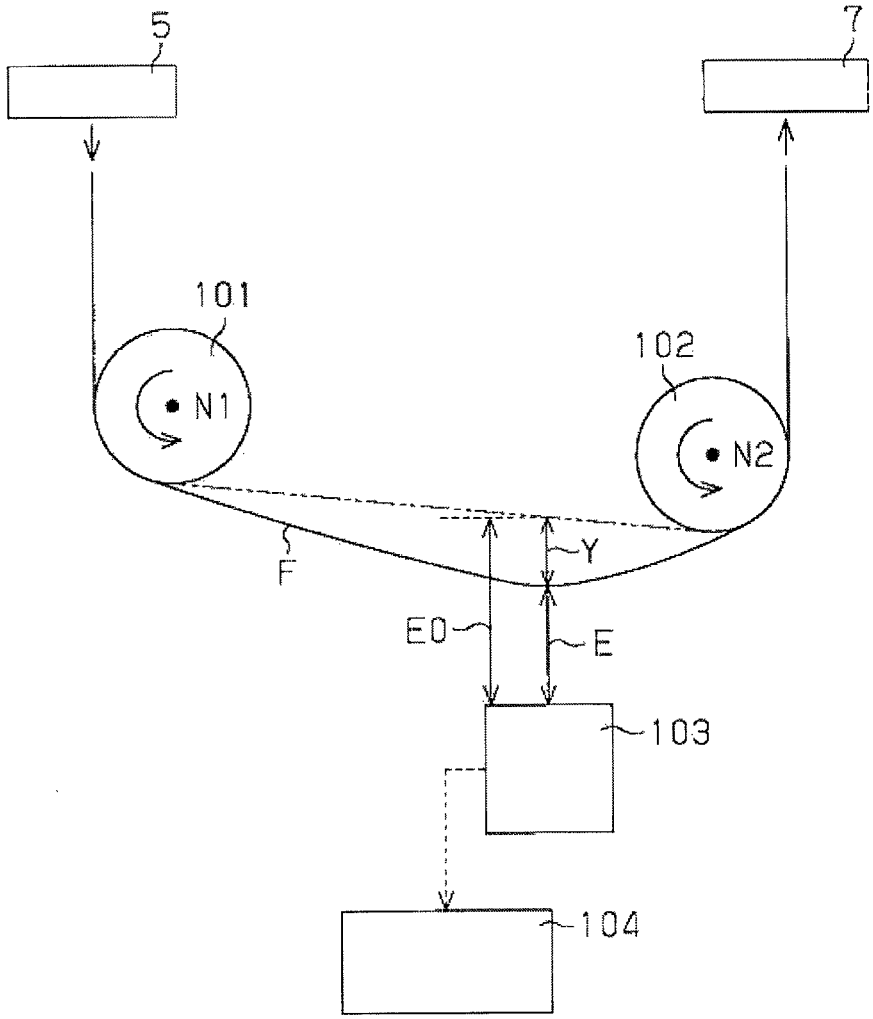
FIG. 4 is a front view schematically showing the frontal structure of a conveying apparatus according to a modification of the present invention.

In the above embodiment, the height of the lowest part of the first roller 1 is equal to the height of the lowest part of the second roller 2 in the vertical direction. Instead, the height of the lowest part of the first roller and the height of the lowest part of the second roller may be different from each other. That is, as shown in FIG. 4, the lowest part of a first roller 101 may be higher than the lowest part of the second roller 102. Alternatively, the lowest part of the first roller may be lower than the lowest part of the second roller. In the former case, as shown in FIG. 4, the position at which the slack amount Y of the nonwoven fabric F is maximized is closer to the second roller 102 than the middle position between the first roller 101 and the second roller 102 in the conveying direction of the nonwoven fabric F. Therefore, in this case also, a sensor 103 is preferably arranged below the nonwoven fabric F at the maximum slack position, where the slack amount Y of the nonwoven fabric F is maximized between the first roller 101 and the second roller 102. The sensor 103 detects a distance E from the nonwoven fabric F at the maximum slack position, and a controller 104 computes a slack amount Y of the nonwoven fabric F based on the detected distance E and a reference distance E0.

As described in the above embodiment and the modifications thereof, it is preferable to compute the slack amount Y at a position where the slack amount Y of the nonwoven fabric F is maximized between the first roller and the second roller to accurately obtain the slack amount Y of the nonwoven fabric F. However, the position at which the slack amount Y is obtained is not limited to this, but the slack amount Y may be computed at other positions. That is, the sensors 3*a*, 3*b* may be arranged below a position other than the position of the maximum slack amount of the nonwoven fabric F.

The noncontact sensors are not limited to laser sensors. For example, a camera that captures an image may be provided as a sensor, and the slack amount Y of the nonwoven fabric F may be computed by processing an image captured by the camera.

As in the above embodiment, to easily and accurately control the rotation speeds of the rollers, it is preferable that the rotation speed N1 of the first roller 1 be set to a constant speed, and that the rotation speed N2 of the second roller 2 be controlled based on the slack amount Y computed using detection results of the sensors 3*a*, 3*b*. However, the present invention is not limited to this, but the rotation speeds of both of the first and second rollers may be controlled. Alternatively, the rotation speed of the first roller may be controlled while maintaining the rotation speed of the second roller at a constant speed.

In the above embodiment, the two sensors 3*a*, 3*b* are employed. However, only one sensor or more than two sensors may be employed.

In the above embodiment, an apparatus for conveying nonwoven fabric has been exemplified, but the present invention is not limited to this. For example, the present invention may be applied to apparatuses that convey sheet material such as a sheet of paper or a sheet of metal.

Therefore, the present examples and embodiments are to be considered as illustrative and not restrictive and the invention is not to be limited to the details given herein, but may be modified within the scope and equivalence of the appended claims.

What is claimed is:

1. A conveying apparatus for conveying a sheet material in a conveying direction, the apparatus comprising:

a first roller that is rotational to convey the sheet material;

a second roller that is rotational to convey the sheet material and is located on a trailing side of the first roller with respect to the conveying direction of the sheet material;

a noncontact sensor that detects a distance from the sheet material at a position between the first roller and the second roller; and a controller that computes a slack amount of the sheet material using the distance detected by the sensor and controls at least one of a rotation speed of the first roller and a rotation speed of the second roller such that a difference between the computed slack amount and a predetermined target value is reduced, wherein the predetermined target value is a function of a distance between the first roller and the second roller, a weight of the sheet material, a tension acting on the sheet material between the first roller and the second roller, and a gravitational acceleration.

2. The sheet material conveying apparatus according to claim 1, wherein the controller controls the rotation speed of the first roller to be a constant speed, and controls the rotation speed of the second roller such that the difference between the computed slack amount of the sheet material and the predetermined target value is reduced.

3. The sheet material conveying apparatus according to claim 1, wherein the sensor is a laser sensor.

4. The sheet material conveying apparatus according to claim 1, wherein the sensor detects the distance at a maximum slack position, where a slack amount of the sheet material is maximized, between the first roller and the second roller.

5. The sheet material conveying apparatus according to claim 1, wherein the sheet material is a nonwoven fabric, the first roller is configured to feed the nonwoven fabric, which is produced by a spinning apparatus, to the second roller, and the second roller performs at least one of pressurization and heating of the nonwoven fabric, which has been conveyed thereto via the first roller.

6. The sheet material conveying apparatus according to claim 1, wherein, if the distance between the first roller and the second roller is represented by L (m), the mass of the sheet material per unit length is represented by b (kg/m), the tension acting on the sheet material between the first roller and the second roller is represented by T (N), and the gravitational acceleration is represented by g ($m/s^2$), the predetermined target value Ytrg (m) is represented by the following expression:

$$Ytrg = \frac{T}{bg}\left(1 - \cosh\left(\frac{Lbg}{2T}\right)\right).$$

7. The sheet material conveying apparatus according to claim 1, wherein a height of a lowest part of the first roller is equal to a height of a lowest part of the second roller.

8. The sheet material conveying apparatus according to claim 1, wherein the noncontact sensor is provided below the sheet material.

9. The sheet material conveying apparatus according to claim 1, wherein a height of a lowest part of the first roller is higher than a height of a lowest part of the second roller.

10. The sheet material conveying apparatus according to claim 9, wherein a maximized slack amount position of the sheet material is closer to the second roller than a middle position between the first roller and the second roller in the conveying direction of the sheet material, and the noncontact sensor is provided at the maximized slack amount position below the sheet material.

11. The sheet material conveying apparatus according to claim 1, wherein the sensor is a camera that captures an image.

* * * * *